US011118852B2

(12) United States Patent
Kroyer et al.

(10) Patent No.: US 11,118,852 B2
(45) Date of Patent: Sep. 14, 2021

(54) GAS-POWERED FIREARM

(71) Applicant: GLOCK TECHNOLOGY GMBH, Ferlach (AT)

(72) Inventors: Josef Kroyer, Zemendorf (AT); Elmar Bilgeri, Steyr (AT); Sereinig Siegfried, Klagenfurt (AT)

(73) Assignee: GLOCK TECHNOLOGY GMBH

( * ) Notice: Subject to any disclaimer, the term of this patent is extended or adjusted under 35 U.S.C. 154(b) by 0 days.

(21) Appl. No.: 17/038,437

(22) Filed: Sep. 30, 2020

(65) Prior Publication Data

US 2021/0207904 A1 Jul. 8, 2021

(30) Foreign Application Priority Data

Oct. 4, 2019 (EP) ..... 19201441

(51) Int. Cl.
*F41A 5/20* (2006.01)

(52) U.S. Cl.
CPC ..... *F41A 5/20* (2013.01)

(58) Field of Classification Search
CPC ..... F41A 5/18; F41A 5/20
See application file for complete search history.

(56) References Cited

U.S. PATENT DOCUMENTS 834,753 A 10/1906 Reifgraber
2,252,754 A * 8/1941 Browning ..... F41A 5/20 89/193
3,988,964 A * 11/1976 Moore ..... F41A 5/28 89/185
4,109,558 A * 8/1978 Panigoni ..... F41A 5/26 89/191.02
4,373,423 A * 2/1983 Moore ..... F41A 5/26 89/191.02
4,817,496 A * 4/1989 Zedrosser ..... F41A 5/20 89/191.02

(Continued)

FOREIGN PATENT DOCUMENTS

CH 321922 A * 5/1957 ..... F41A 25/12
DE 102017002165 A1 9/2018

(Continued)

OTHER PUBLICATIONS

EPO Search Report for related EP application 19 20 1441, dated Feb. 13, 2020.

*Primary Examiner* — Gabriel J. Klein
(74) *Attorney, Agent, or Firm* — Raven Patents, LLC

(57) ABSTRACT

A rifle with a barrel firmly mounted in a framework, the barrel including a locking sleeve, a lock, a sliding block, and a gas-powered actuator. Advantageously quiet operation of the gas-powered actuator is accomplished when the actuator has an annular piston, which is movable on a plunger support, forming an expansion chamber, where the actuator acts on the sliding block via push rods and is pushed forward by reset springs, and the rifle further includes a gas borehole penetrating the walls of the barrel and the plunger support, and further where the plunger support includes an outlet channel in its front, upper range, which is fluidly separate from the expansion chamber when the annular piston is at rest, and is fluidly connected with the expansion chamber after a backward displacement of the annular piston.

19 Claims, 6 Drawing Sheets

(56) References Cited

U.S. PATENT DOCUMENTS

| | | | | |
|---|---|---|---|---|
| 5,429,034 | A * | 7/1995 | Badali | F41A 5/28 89/191.02 |
| 7,891,284 | B1 | 2/2011 | Barrett | |
| 8,596,185 | B1 | 12/2013 | Soong | |
| 8,640,598 | B1 * | 2/2014 | Jackson | F41A 5/20 89/191.02 |
| 8,752,471 | B2 | 6/2014 | O'Brien | |
| 9,500,422 | B2 * | 11/2016 | Gomirato | F41A 5/28 |
| 2013/0291713 | A1 * | 11/2013 | Zheng | F41A 5/20 89/191.02 |
| 2019/0226776 | A1 * | 7/2019 | DiChario | F41A 21/48 |
| 2020/0378702 | A1 * | 12/2020 | DiChario | F41A 5/28 |
| 2021/0137871 | A1 * | 5/2021 | Sanders | A61P 35/00 |

FOREIGN PATENT DOCUMENTS

| | | | |
|---|---|---|---|
| EP | 0272248 | A2 | 12/1987 |
| EP | 0634620 | A1 | 1/1995 |
| EP | 1162427 | A2 | 12/2001 |

* cited by examiner

GAS-POWERED FIREARM

TECHNICAL FIELD

The present disclosure is directed to repeating firearms that include a gas-operated action, and more particularly to gas-powered actuators for such firearms.

BACKGROUND

The state of the art comprises numerous different gas-powered rifles that are invariably designed to also use the propellant gas, which propels the projectile, to open the breech, to expel the empty cartridge case, to effectuate the insertion of the next cartridge from the magazine, to again close and lock the breech and to cock the firing pin mechanism—all in connection with various springs.

To accomplish this, it is conventional to provide at least one gas withdrawal hole, which is also called gas port, through which the propellant gas is passed to a plunger that moves the lock backwards by means of rods or a gas channel, in that locking lugs on the lock collaborate with locking nuts on the barrel in opening the lock. After the propellant gas escapes, the plug is moved forward and is locked again by means of a return spring. There are numerous suggestions for implementing this seemingly simple sequence of operations:

EP1,16,2427A1 discloses a gas-flow device for semiautomatic or automatic shotguns, consisting of a gas-flow cylinder, closed at the front part by a flange with gas ports around the tube-like ammunition magazine, opposite the cylinder a circular valve that moves axially for controlled opening and closing of the gas ports. The valve is kept in the closed position by a pre-stressed spring and moves to the open position when the gas pressure in the expansion chamber increases beyond a set value. This proposed gas-flow device of is located considerably off-axis the barrel axis around the shell containing tube-magazine, and the spring is located around the magazine, which is considered unsuitable for the use in box-magazine fed rifles.

U.S. Pat. No. 8,752,471 proposes to dispose the return spring in a pistol with a fixed barrel concentric to the barrel axis and the gas port(s) near the muzzle. The plunger has the shape of an annulus and rests inside against the barrel, outside against the barrel cover. In practice, particularly in the case of automatic weapons, this creates considerable problems with the heating of the barrel. Because of the far forward location of the gas withdrawal hole, propulsion gas is only supplied for a very short time because the supply is terminated by pressure equalization after the projectile has left the barrel.

U.S. Pat. No. 834,753, dating back to 1904, suggests providing a gas port in a pistol with an axially displaceable barrel, which hole can be set so as to allow more or less gas to escape via a hole in a ring-shaped plunger (or synonymously understood as piston) and acts as a kind of adjustable valve. The energy acting on the movable barrel is thus controlled. The risk of contamination and the difficulty of cleaning the weapons make this idea unsuitable for automatic weapons in harsh outdoor environments.

EP 272 248 reveals a long-stroke gas-operated actuator with a regular sleeve plunger and a return spring arranged around the barrel. The guidance is performed on the barrel, which is, for this purpose, equipped with ring grooves so as to reduce friction and with the effect of a labyrinth seal. In this way the propulsion gases act over a considerably larger part of the long path of the plunger than in other weapons.

But it is, in many instances, just this long displacement path of a part having a considerable mass that can be regarded as a disadvantage.

U.S. Pat. No. 8,640,598, generally intended for firearms, proposes a design of the longitudinally movable parts having a mass that is as low as possible so as to avoid bucking the weapon and accomplishes this with a configuration having two push rods, which connect the plunger with the lock, disposed symmetrically on the left and the right of the barrel. As a result, the outer wall of the cylinder of the gas-powered actuator has a gas port, so that the plunger rapidly loses power upon passing over it and only continues to move due to inertia. The rear part of the push rods is surrounded by compression springs, by means of which they are moved forward again. The motion of the lock is caused by its own spring.

U.S. Pat. No. 7,891,284, like U.S. Pat. No. 8,596,185 as well, has a control device (gas plug) for gas passage in the supply line for supplying the propulsion gas between the gas port (or gas passage) and the inlet opening to the cylinder. While this allows for an exact accommodation to the ammunition being used, it nevertheless amounts to a problem for operational reliability because this delicate part consisting of numerous small components is easily dirtied.

DE10,2017/002165 describes a short-stroke gas-powered actuator including the components for mounting it on the barrel, with the adjustability of the effective operating power being effectuated by twisting a gas flow adjusting sleeve at the outlet of the propulsion gas. The necessarily eccentric alignment with respect to the operating axis and the necessary numerous components are the disadvantages of this solution.

The content of EP1,16,2427A1, U.S. Pat. Nos. 8,752,471, 834,753, EP272248, U.S. Pat. Nos. 8,640,598, 7,891,284, 8,596,185 and DE10,2017/002165 is hereby incorporated by reference into this application.

A distinction must, in principle, be made between long-stroke gas-powered actuators having path lengths of at least 45 mm as described in EP 272 248 and short-stroke actuators with path lengths mostly lower than 25 mm as described in DE10,2017/002165. The former have the problem of having to displace relatively large masses over long paths; the latter have the problem of having to deliver sufficient energy over a short path; actuators having intermediate path lengths are not common.

SUMMARY

This disclosure is directed to a gas-powered firearm, typically a rifle, having an upper part that contains at least: a barrel, possibly with a locking sleeve, a locking mechanism, a firing pin mechanism, a gas mechanism and a cover. This upper part is connected (preferably detachably connected) to a lower part that contains at least a grip stock, a magazine and a trigger mechanism. The latter may be in an assembled, ready-to-fire condition with the firing pin mechanism in operative connection. In particular, the disclosure is directed to a gas-powered actuator for a firearm.

The disclosure may include a firearm, including a framework; a barrel that is firmly mounted within the framework, the barrel defining an operating axis; a locking sleeve that is connected to the barrel, the locking sleeve including a lock, a sliding block, and a gas-powered actuator. The gas-powered actuator may include a plunger support having an annular piston that is located in a displaceable manner on the plunger support; an annular expansion chamber in a region behind a front surface of the annular piston, the annular expansion chamber being defined by an axial section of the annular piston having a reduced internal radius in combination with the plunger support, and where the expansion chamber is fluidly connected with a gas borehole penetrating a wall of the barrel and the plunger support; is urged in a forward direction by one or more reset springs; and is configured to act upon the sliding block by way of one or more push rods. The gas-powered actuator further includes an outlet channel defined by a foremost protruding portion of the annular piston in combination with an overflow limit of the plunger support and the region before it; where the outlet channel is fluidly separated from the expansion chamber when the annular piston is at rest, and is fluidly connected with the expansion chamber after a backward displacement of the annular piston.

The disclosure may include a rifle, including a framework; a barrel that is firmly mounted within the framework, the barrel defining an operating axis; a locking sleeve that is connected to the barrel, the locking sleeve including a lock, a sliding block, and a gas-powered actuator. The gas-powered actuator may include a plunger support having an annular piston that is located in a displaceable manner on the plunger support; the annular piston including a plurality of outlet channels, each outlet channel having a different geometrical design than the other outlet channels, and each outlet channel corresponding to a distinct energy selector length. The gas-powered actuator may further include an annular expansion chamber in a region behind a front surface of the annular piston, the annular expansion chamber being defined by an axial section of the annular piston having a reduced internal radius in combination with the plunger support, and where the expansion chamber is fluidly connected with a gas borehole penetrating a wall of the barrel and the plunger support; is urged in a forward direction by one or more reset springs; and is configured to act upon the sliding block by way of one or more unitary push rods. The gas-powered actuator may further include an outlet channel defined by a foremost protruding portion of the annular piston in combination with an overflow limit of the plunger support and the region before it; where the outlet channel is fluidly separated from the expansion chamber when the annular piston is at rest, and is fluidly connected with the expansion chamber after a backward displacement of the annular piston.

BRIEF DESCRIPTION OF THE DRAWINGS

The disclosed firearm is hereinafter described in greater detail by means of the drawings, as described below.

DETAILED DESCRIPTION

Within the present description and in the claims, the term "firearm" can refer to any gas-operated firearm. Although the present disclosure specifically describes long guns, such as rifles, carbines, shotguns, and the like, the disclosure should not be considered to be limited to long guns.

If a firearm of the present disclosure includes a locking sleeve, the locking sleeve may be considered part of the barrel and need not be mentioned separately.

The gas-powered actuator of the firearm of the present disclosure may include the following features:

- It may have an annular piston enveloping the barrel;
- It may have two possibly mutually connected push rods extending from the annular piston to the sliding block of the lock over most of its length, i.e. over 50% of its length, i.e. two possibly interconnected push rods, disposed symmetrically with respect to the center plane of the firearm, which preferably has a lengthwise rectangular cross section;
- It may be pushed to its end position by means of two helical return springs disposed symmetrically about the center plane of the firearm.
- It may include a gas outlet located at the front of the actuator above the axis of the barrel; and
- The push rod—sliding stock contact in the actuator may persist until the steering lugs of the sliding stock have axially left the steering lugs of the barrel behind, if such steering lugs are present.

Figure 1:
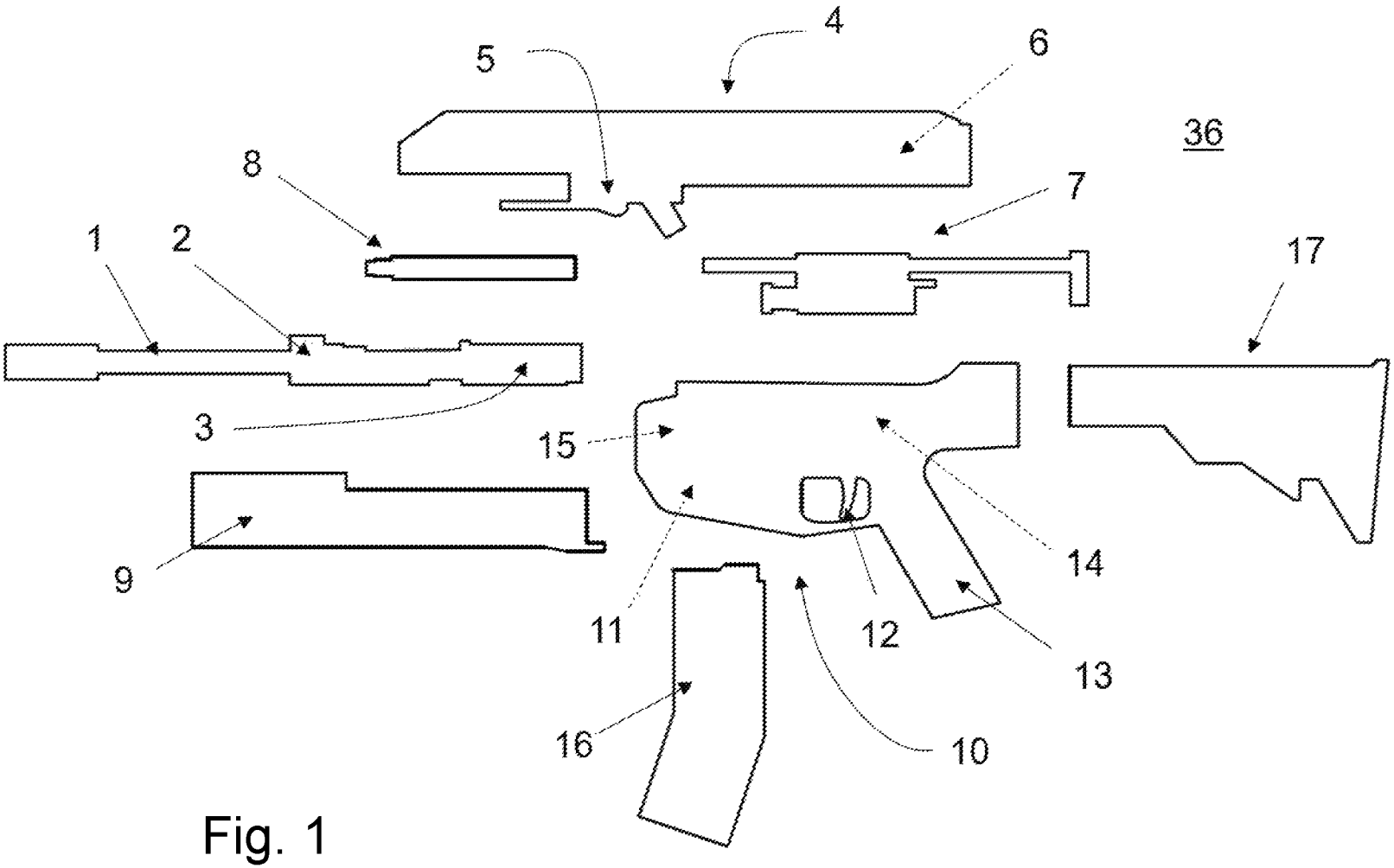
FIG. 1 is a schematic drawing of the individual components of a rifle, which can be configured according to the present disclosure.

FIG. 1 shows a purely schematic, silhouette-like representation of the components listed below in the center plane 36 of the weapon in a functional view of a fully equipped rifle, including, e.g., a barrel 1 with an operating axis, a gas-powered actuator 2, a locking sleeve 3, an upper housing, also called an upper 4 outside of the USA, a support 5, a lock 7, a spring tension slide 8, a front stock 9, a lower housing, also called a lower 10, which in turn comprises a magazine holder 11, a trigger mechanism 12, a grip stock 13 and a lock catch device 14, a center latch 15 for connecting the upper and lower, a magazine 16 and a stock 17. Guides 6 for the lock 7 and/or the spring tension slide 8 can also be provided in the upper housing 4.

Not all of these parts need to be present, but additional parts, e.g. mounting elements for telescopic sights, for laser pointers and the like, can also be present. It is also possible for several of the aforesaid components to be integrated in a complex structural element, as is, e.g., the case with the lower 10 in this instance, so that this image is just an example of a rifle having a highly modular structure.

Figure 2:
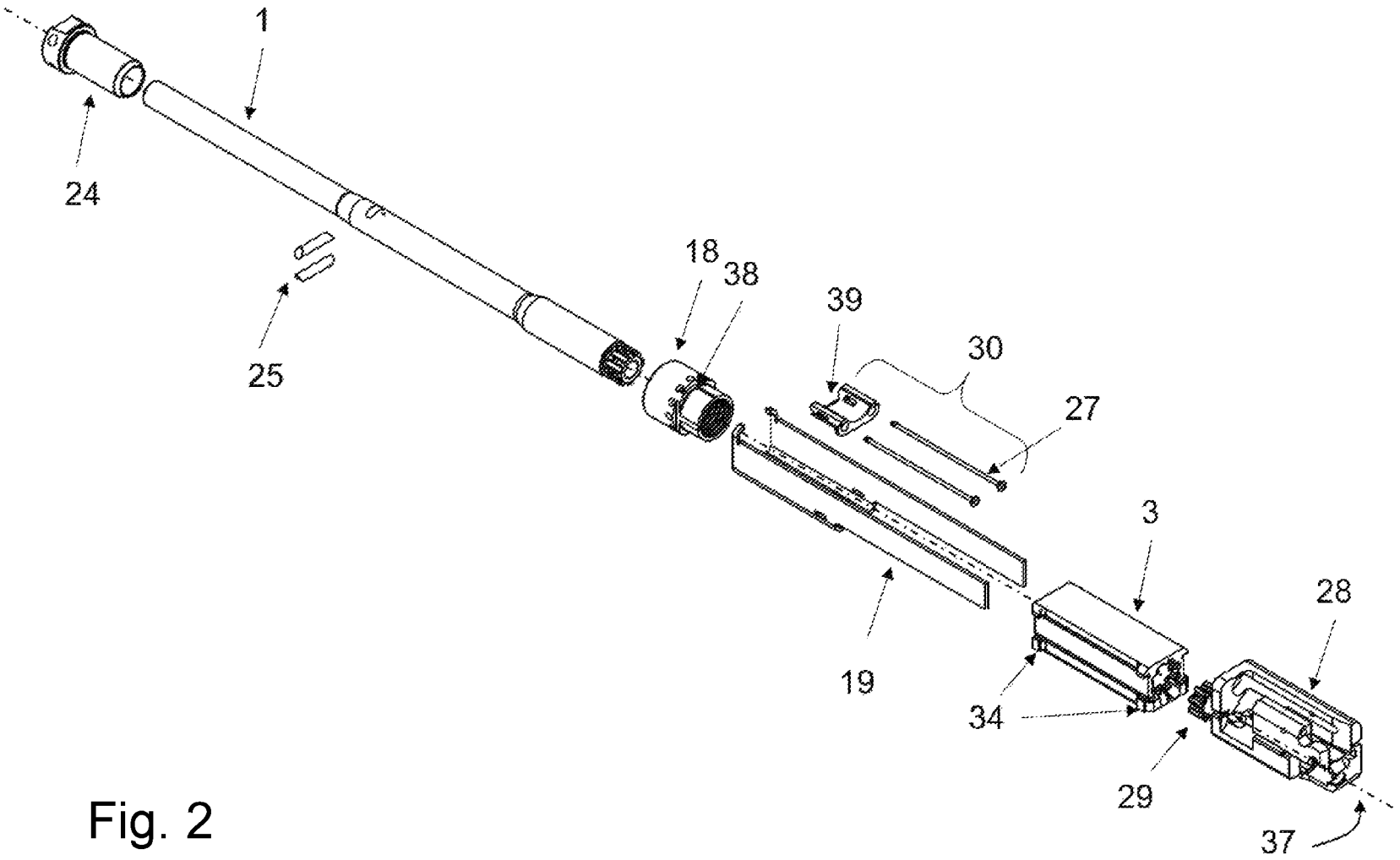
FIG. 2 is a schematic exploded view of an exemplary gas-powered actuator according to the present disclosure.

An example embodiment of a gas-powered actuator 2 according to this invention is pulled apart in perspective view along the operating axis 37 of an exploded drawing shown in FIG. 2. The parts, from the front to the rear, are: A plunger support 24, which is pushed onto the barrel 1 and attached to it. It essentially has the shape of a pipe or a sleeve. It has a front section with a greater wall thickness and a circular overflow limit 21, and a rear section with smaller wall thickness. It is tapered at its rear end. It additionally has slanting radial holes (FIG. 3A), which fully permeate its casing.

The plunger support 24 is appropriately attached to the barrel 1. In the example embodiment being shown, this happens by means of two mounting pins 25, which are pushed, transverse to the operating axis 37 and perpendicular to the center plane 36 of the weapon, into notch-shaped recesses in the mantle of the barrel and through holes in the plunger support 24, and are held in place by means of a press fit or an adhesive, whereas it is also possible to use spring sleeves. Other mountings of the plunger support on the barrel 1 (by gluing, soldering, a press fit, screwing, etc.) are possible.

The barrel 1 is equipped with state-of-the-art lugs, etc. (no reference numbers) at its rear end pointing toward the weapon. An oblique radial gas borehole 20 (FIG. 3A) is respectively provided in the region of the seat of the plunger support 24, in the design example next to the recesses for the mounting pins 25, which thus lie in the center plane 36 of the weapon. These gas boreholes connect the barrel bore with the outside. In the assembled state of the plunger support, the gas boreholes 20 in the barrel 1 align with the holes in the plunger support 24 and are jointly simply called boreholes.

A gas plunger, also called an annular piston 18, is pushed (fittingly from the rear) onto the barrel 1 and sits on the plunger support 24 so that it is axially displaceable. It is in principle ring-shaped, as is for example evident from FIGS. 2 and 3*a*. Its front region has an inner diameter, which allows it to slide in a spaced manner over the largest outer diameter as well as over an overflow limit 21 of the plunger support 24 until a front surface of the annular piston 18 rests against the overflow limit 21. An axial section with a reduced internal radius, which, along with the plunger support 24, constitutes a ring-shaped expansion chamber 23, follows in the region behind the front surface. A section, which provides for guidance and sealing of the annular piston 18 at the plunger support 24, is in turn attached to the expansion chamber 23. Blockage can be efficiently avoided by way of a sufficient longitudinal extension of this section during operation. A configuration of the internal lateral surface of the annular piston 18 as a labyrinth seal 26, with which it is relatively simply but efficiently sealed against the outer casing of the plunger support 24 as shown in FIGS. 3A and 3B, is particularly preferred.

Figure 3A:
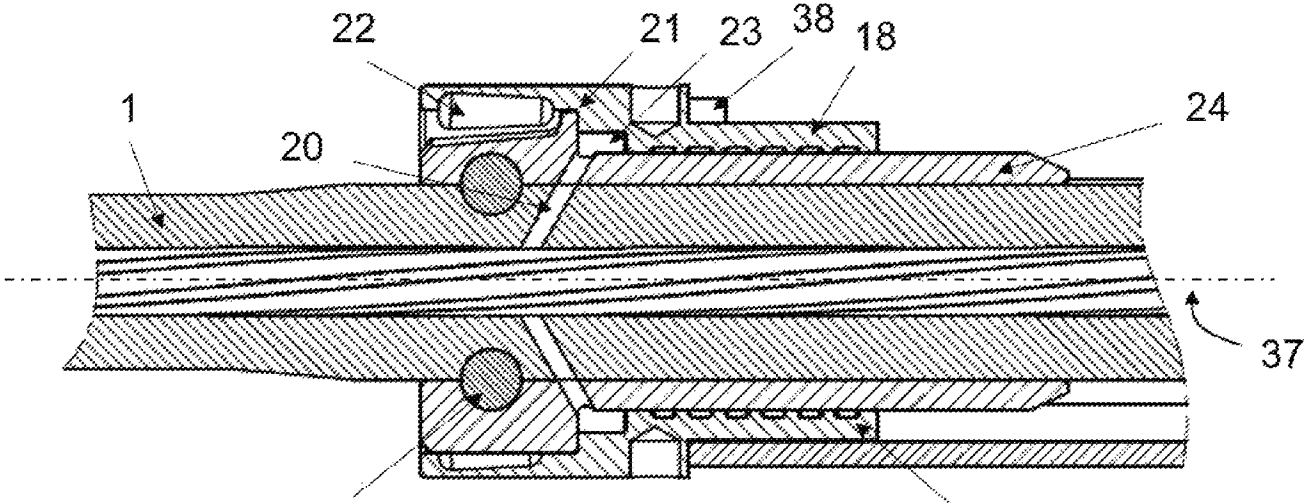
FIG. 3A shows a section through the center plane of an exemplary firearm in the ready-to-fire position of the individual parts of the gas-powered actuator.
Figure 3B:
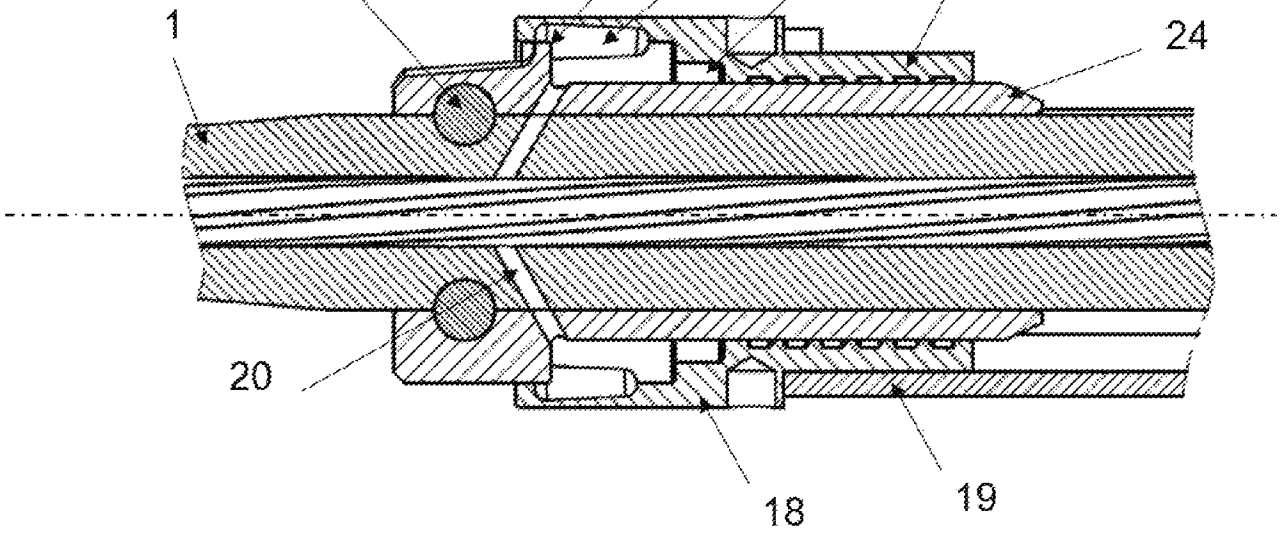
FIG. 3B shows a section through the center plane of the exemplary firearm after a shot has been fired with the position of the individual parts of the gas-powered actuator at that time.

The protruding, foremost part of the annular piston 18 forms an outlet channel 22 with the overflow limit 21 of the plunger support 24 and the region before it, which outlet channel 22 is closed by the front surface abutting the overflow limit 21 as shown by the ready-to-fire configuration displayed in FIG. 3A. The annular piston 18 has at least one pocket-shaped recess 32 in its inside shell in the region lying before the overflow limit 21, which recess forms the aforesaid outlet channel 22 along with the outside surface of the plunger support 24. It is particularly advantageous if both the plunger support 24 and the annular piston 18 have corresponding recesses 32 and/or flat areas on the plunger support 24 so as to form a particularly well-defined outlet channel 22.

It should be noted that the expansion chamber 23 can have very different shapes and that it is possible to do without it as a last resort. The same thing applies to the labyrinth seal 26; both depend on the ammunition that is used and the overall design of the weapon.

The annular piston 18 can have planar gradations 38 in planes parallel to the center plane 36 of the weapon and, at a right angle thereto, parallel to the operating axis 37 in the back region, roughly coinciding with the axial region of the labyrinth seal 26. These small-area, shallow gradations 38 serve the purpose of securing the angular position against unintended twisting (or, synonymously used, rotating), as explained further below, and constitute a part of the positional fixation 33.

As is furthermore evident from FIG. 2, the annular piston 18 is operatively connected to two push rods 19, which are, in the example embodiment that is shown, connected to each other in the front region over a part of their axial length by means of a breech and preferably, as shown, have a one-piece design. The application and the claims nevertheless speak of connecting rods 19 in the plural. It can thereby be assured via a suitable geometrical design that, despite the breech, the balance point lies in the operating axis 37. These push rods 19, also called pressure rods, can have numerous recesses and/or holes for purposes of weight reduction and/or optimization. The push rods 19 are preferably produced as a stamped and curved sheet metal part, and it is possible to introduce corrugations or reinforcements for purposes of increasing the stiffness while maintaining a low weight. The gas linkage can alternatively also be configured as a 3D pressure part.

FIG. 2 additionally shows a spring unit 30 comprising two return springs 27 with a guiding piece 39 for the push rods 19, which ensure that the latter is pushed to its forward position as shown in FIG. 3A. Two such springs are preferably provided; the state of the art proposes just one spring, which is often wound around the barrel 1, and the like. Two return springs 27 are preferred for thermal reasons and reasons of symmetry; for reasons of space, they can be disposed on the side or below the operating axis 37, depending on the overall design of the weapon.

FIG. 2 is subsequently a schematic view in the axial direction of a locking sleeve 3, which is firmly connected to the barrel 1, at least when the weapon is used. It is mounted on the rear-most part of the barrel, which is thickened in the example embodiment shown; but the state of the art provides numerous possibilities, all of which can be used. The rear end surface of the locking sleeve 3 has a geometric design, which interacts with the lugs, etc. of a lock head unit 29. According to the invention, guide extensions 34 are disposed or formed in the locking sleeve 3 and the outer contour can additionally be equipped with a flat indentation located in between them and extending axially, into which the push rods 19 come to lie, as particularly illustrated by FIG. 5.

FIG. 2 lastly displays a sliding block 28, which already belongs to the movable lock 7 and which moves with it (at least over a section of its path). The sliding block 28 carries a lock head 29, possibly made of one piece, on its front side, which is equipped with nubs, lugs, etc. and collaborates with the aforementioned counterparts on the locking sleeve 3. The sliding block 28 is part of the lock 7, which additionally comprises a recoil spring unit not shown in detail as well as a firing pin and firing pin safety lock. These components are not shown for the sake of simplicity so as to improve the overall view.

Figure 7:
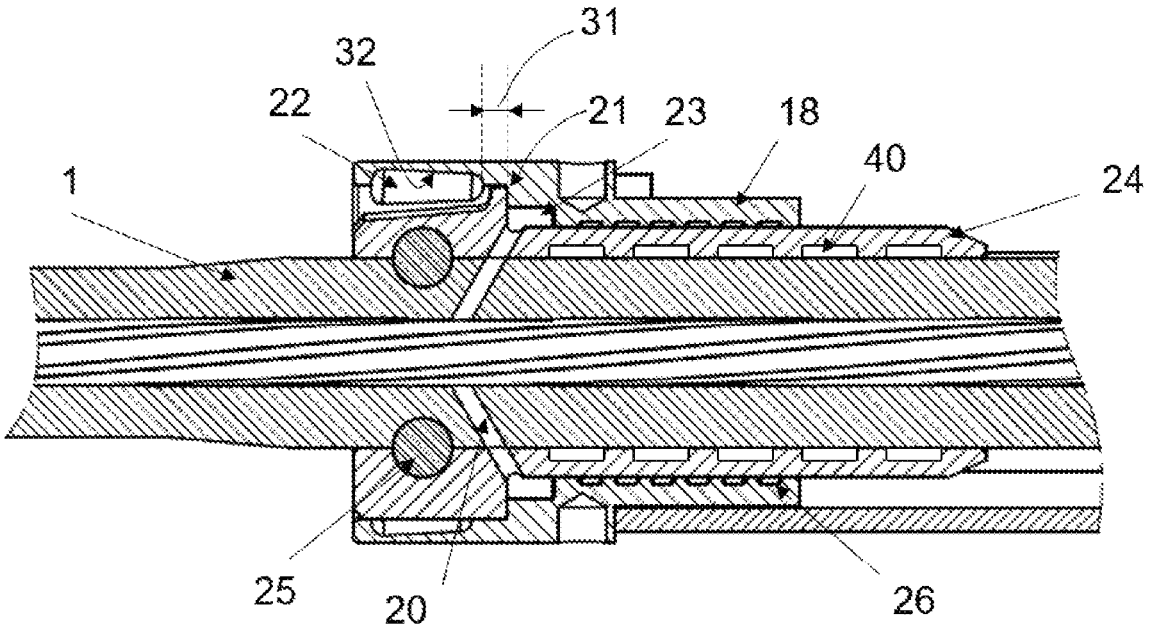
FIG. 7 depicts a section view similar to that shown in FIG. 3A on an enlarged scale with additional details.

The working principle is then as follows: If the projectile in the barrel 1 gets past the gas boreholes 20 (FIG. 3A) after a shot is fired, the explosion gases pass into the expansion chamber 23 through the latter and push the annular piston 18 to the rear against the force of the return springs 27. The push rods 19 that are moved along push the sliding block 28 to the rear; the connection between the barrel 1 and the locking sleeve 3 with the lock head 29 is loosened by connecting links such as those known in the state of the art. The lock head 29 moves to the rear along with the sliding block 28, the firing pin including the mechanisms. In doing so, the front face of the annular piston 18 moves away from the overflow limit 21 and, after passing through the path length 31 (FIG. 7), the outlet channel 22 is opened by the recess 32, which leads to the almost instantaneous release of the excess pressure in the expansion chamber 23 in a very short time. The path length 31 thus acts in a proportional way on the acceptable gas pressure in the expansion chamber 23, which is why the designation "energy selector length" is used. The inertial forces can ensure that the axial displacement of the annular piston 18 gets to the position shown in FIG. 3B, beyond which it cannot go because the of the abutment of a leading edge of the push rods 19 to the locking sleeve 3. The annular piston 18 is pushed forward again from this position by the return springs 27.

The symmetrical configuration, in particular that of the gas escape holes 20 and the push rods 19, in cooperation with the slim design, particularly the design of the push rods 19, allows for a significant reduction of the tilting moment acting on the weapon when it is fired.

When a shot is fired, a predeterminable impulse, which is characteristic of the kind of munition and/or the caliber and/or the load is furthermore, according to this invention, transferred from the annular piston 18 to the pressure rods and/or push rods 19 and from them directly to the sliding block 28. The relatively large contact area between the push rods 19 and the sliding block 28 allows for a low surface pressure, whereby a lower wall thickness of the push rods 19 and a weight optimization accompanying it becomes possible.

The end stop of the push rods 19 in their backward motion can, for example, be formed by lengthwise extending recesses in the push rods 19 and corresponding extensions on the locking sleeve 3. But the pressure linkage preferably has a one-piece design (see FIG. 2), with the breech interconnecting the push rods 19 to each other and the end stop thus being an integral part of the breech.

The gas-powered actuator 2 according to the invention offers a number of advantages compared with known short-stroke systems (generally less than 15 mm of stroke length) as well as long-stroke systems (usually more than 30 mm of stroke length). The gas-powered actuator 2 has a medium stroke length at the plunger support 24, preferably lying between 15 and 35 mm, particularly preferably between 20 and 30 mm. A stroke length within this medium range allows a sufficient momentum to be transferred to the sliding block 28 on one hand, and the stroke length also suffices to allow the locking and/or unlocking process to proceed in a controlled manner on the other hand. This guidance in the range of the medium stroke length allows the relatively "heavy" lock 7 to be actuated without a problem, since a direct transmission of power to the sliding block 28 essentially takes place due to the low number of boundary surfaces, whereby energy reserves can be maintained and functional reliability is thus facilitated. The stroke length of the gas-powered actuator 2 is moreover selected in such a way that, during the unlocking process, the sliding block 28 is always guided and contacted by the pressure rod and/or push rod 19 until the contact phase ends when the push rod 19 hits the stop of the push rod 19 at the locking sleeve 3. The ejection of the shell also takes place in a guided and controlled manner during this phase. This avoids a malfunction in the event of a different/faulty pulse. The envisioned gas-powered actuator 2 additionally offers the advantage that the masses of the moving components being used are distributed relatively concentrically about the operating axis 37 and an eccentric momentum when firing can thus be avoided. The present invention has the further advantage, in particular over known gas systems in which the gas pressure is applied "directly" to the locking unit generally called "direct impingement"), that the gas-powered actuator 2 causes no contamination in the area of the lock 7 and/or the sliding block 28. It is furthermore relatively easy to disassemble and clean the present structure.

Figures 6A, 6B, 6C:
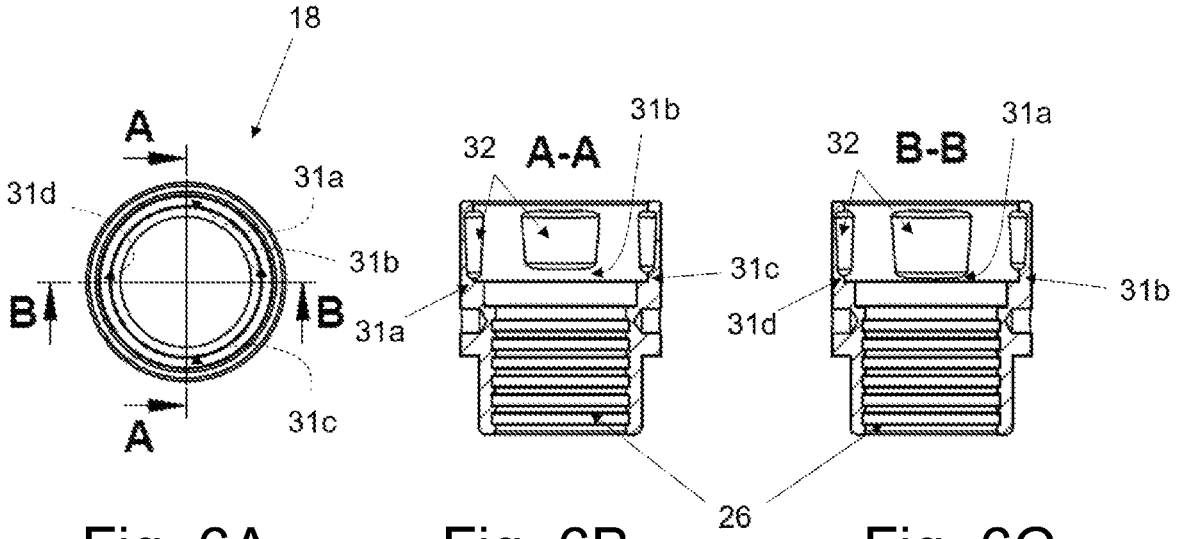
FIG. 6A shows the section views of FIGS. 6B and 6C, perpendicular to the operating axis near the annular piston.
FIG. 6B shows the sectional view along the lines A-A of FIG. 6A.
FIG. 6C shows the sectional view along lines B-B of FIG. 6A.

The drawings also show the following alternative structures and embodiments, which are described below:

As shown in FIGS. 3A and 3B, the annular piston 18 displayed therein can have several, preferably four recesses 32 offset with respect to each other by 90°, of different sizes and/or axially differently located (with the reference numbers 31*a*-31*d* in FIGS. 6A-6C). The energy selector lengths 31*a*-31*d* are, to that effect, of different lengths and, in this way, allow for a different path length of the annular piston 18 to the rear in the axial direction, whereby the pressure in the expansion chamber 23 can build up until the overflow limit 21 is reached and the gas can suddenly escape into the environment. The annular piston 18 can be rotated about its axis of rotation, which coincides with the operating axis 37 in the assembled state, whereby the characteristics of the gas-powered actuator 2 can be adapted to the respective ammunition and/or situation in a simple and very effective way. A particular advantage of the axial displacement compared with the usual adjustment options, such as for instance the limitation of the pass-through opening of the gas borehole, is that the full gas pressure is effective until the overflow limit 21 is reached by way of the recess 32, and the important, first shock-like actuation of the annular pistons 18 thereby reliably causes the lock 7 to open. The formation of the outlet channel 22 at the top (and/or on the side) of the plunger support 24 can lead to a reduction of the recoil, since the combustion gases strike forward against the annular surface of the plunger support and produce a "draft" forward.

Figure 4:
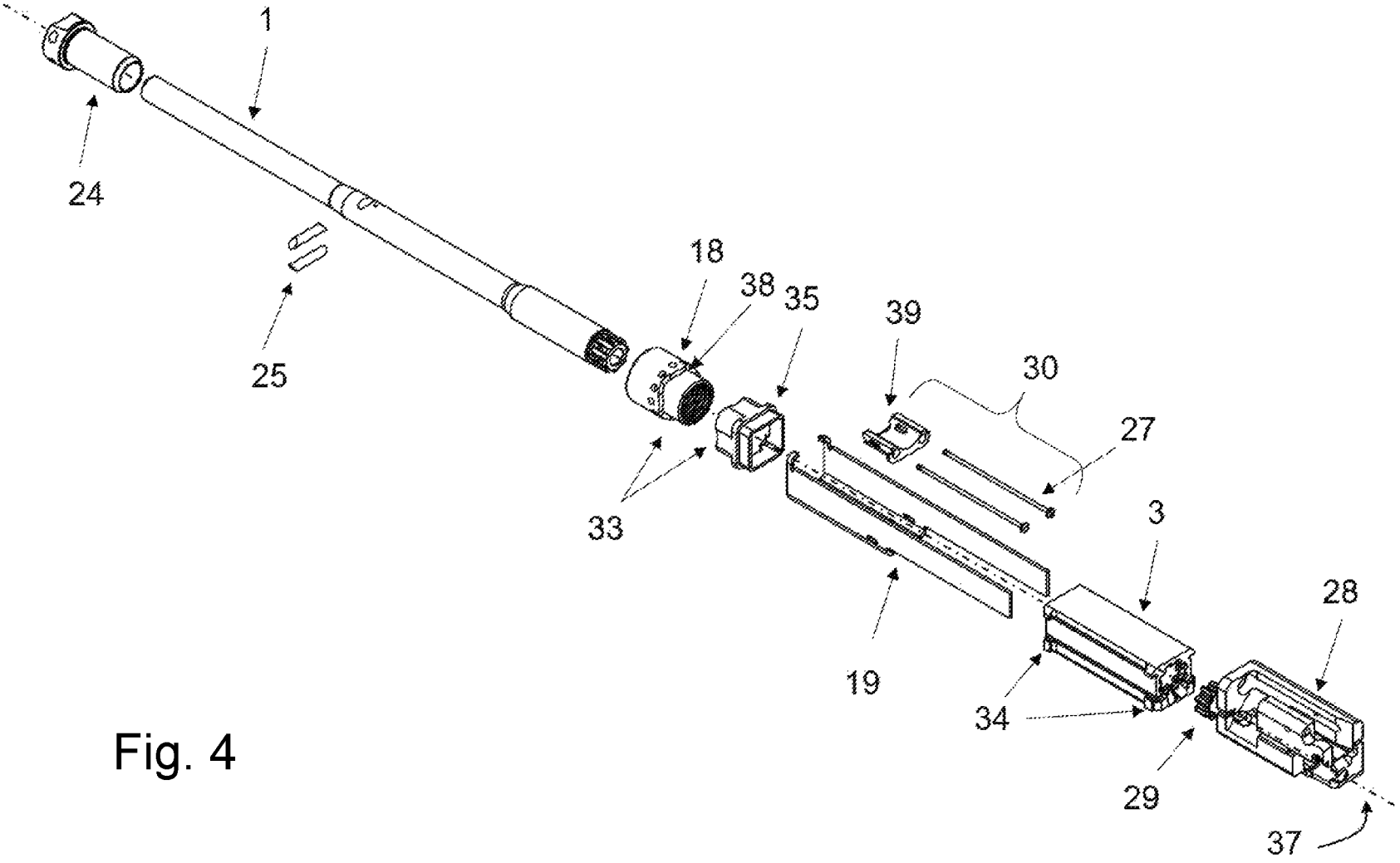
FIG. 4 depicts an alternative gas-powered actuator according to the present disclosure, similar to the actuator of FIG. 2.
Figure 5:
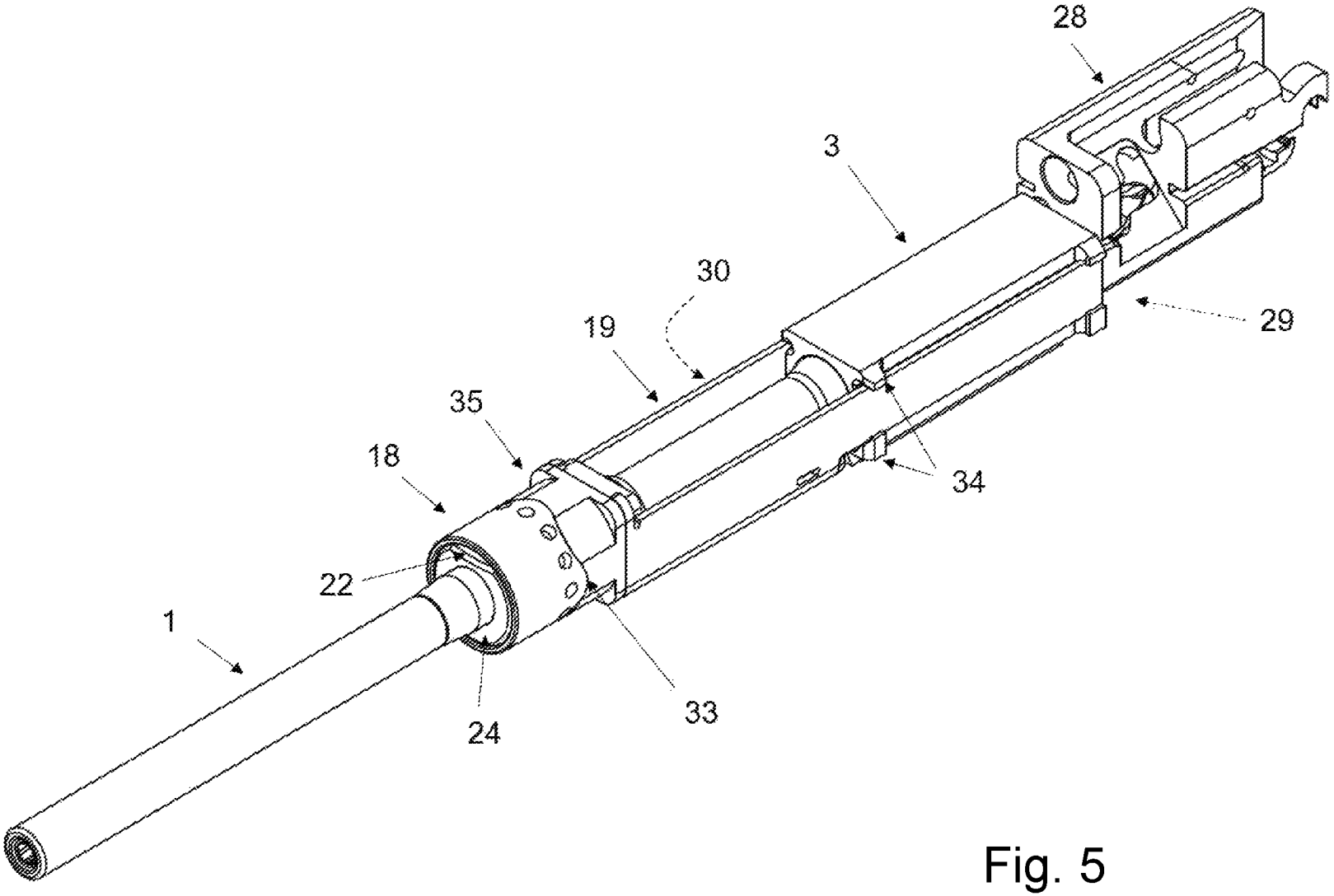
FIG. 5 is a perspective view of the gas-powered actuator of FIG. 4 in the assembled condition.

FIGS. 4 and 5 show an embodiment in which an adapter 35, which can also be configured to be of one piece (integral) with the front end of the push rods 19, is disposed behind the annular piston 18. Its front surface is corrugated or else serrated compared with a plane that is normal to the operating axis 37, the rear side of the annular piston 18 likewise in complementary way. This makes it possible to rotate the annular piston 18 with respect to the adapter 35 about the operating axis, in which case slight resistance by the return springs 27 must be overcome. This axial force also secures the angular position of the respectively selected annular piston 18 against unwanted rotation, and thus the desired overflow properties of the selected recess 32. Four possibilities (90° circumferential angle) are shown; another number of possibilities is achievable in the context of the available space.

In this respect, back to FIG. 2 and the positional localization 33 represented there, which comprises gradations 38 on the rear side of the annular piston 18, which collaborate in the same way with the front of the push rods 19, which are configured with a shape that is complimentary to the gradations 38. Because the geometry rotations of 90° are considered to be advantageous, possible changes to several angular positions with correspondingly complex configurations are achievable and can be provided by an expert.

It is thus clear from an overview of FIG. 2 or FIG. 4 in conjunction with FIG. 5 that the return springs 27 are propped up toward the "rear" by the locking sleeve 3 and push the push rods 19 toward the "front" by way of a guiding piece 39. The annular piston 18 is thus always held in a pre-specifiable angular position through the preloading of the return springs 27, with the force acting on the annular pistons 18 either being applied directly by the, preferably one-piece, push rod 19 (see FIG. 2) or alternatively indirectly via an adapter 35 (see FIG. 4). To alter the angular position of the annular piston 18 and/or to change the gas pressure setting, it is only necessary to pull the gas push rods 19 a few millimeters toward the "rear" so as to be able to rotate the annular piston 18. It is thus not possible to perform an unintentional alteration while firing (in the event of sustained firing as well), but a rapid change of the gas pressure setting in the event of a change in caliber and/or of ammunition is possible. Numerous blind holes, into which one can, e.g. stick a disassembly pin or, as a last resort, a cartridge, in order to get a lever, are located in the circumferential direction around the annular piston 18 for purposes of facilitating the rotation of the annular piston 18 as shown in FIG. 2 and FIG. 4.

With another possible embodiment, the plunger support 24 has an inside contour with one or more recesses 40. The expert can configure these recesses 40 to reduce and/or purposefully modify the contact area of the plunger support 24 with the outer wall of the barrel and thus avoid a heat build-up in the barrel 1 in the area of the plunger support 24, and therefore unwanted thermally induced stress or even a reduction of the diameter of the barrel. These recesses 40 can e.g. be configured as extensive grooves and as lattice-shaped recesses as well, with the specific design performed by the specialist taking the geometric, mechanical and/or thermal requirements into consideration.

It should be stated in summary that the invention concerns a rifle with a framework within which a barrel 1 is firmly mounted, with a locking sleeve 3 connected with the barrel, with a lock having a sliding block 28, which forms a cartridge chamber with the locking sleeve 3, with a gas-powered actuator comprising an annular piston 18, which is positioned in a displaceable manner on a plunger support 24 thus forming of an expansion chamber 23 acting on the sliding block 28 by means of push rods 19 and being pushed forward by return springs 27, with a gas borehole 20 penetrating the wall of the barrel 1 and the plunger support 24. This rifle is characterized in that the plunger support 18 has an outlet channel 22 in its front, upper range, which is separated from the expansion chamber 23 when the annular piston 18 is at rest and is fluidically connected with an outlet channel of the annular piston after a backward displacement.

The following numbered paragraphs describe selected additional aspects and features of the firearms of the present disclosure. Each of these paragraphs can be combined with one or more other paragraphs, and/or with disclosure from elsewhere in this application, including materials incorporated by reference, in any suitable manner. Some of the paragraphs below expressly refer to and further limit other paragraphs, providing without limitation examples of some of the suitable combinations.

A1. Rifle with a framework in which a barrel (1) with an operating axis (37) is firmly mounted, with a locking sleeve (3), connected to the barrel (1), with a lock (7), with a sliding block (28), with a gas-powered actuator (2), the gas-powered actuator (2) comprising a plunger support (24) has an annular piston (18), which is located in a displaceable manner on said plunger support (24), a ring-shaped expansion chamber (23) constituted by an axial section with a reduced internal radius of the annular piston (18) along with the plunger support (24), in the region behind the front surface of said annular piston (18), characterized in that said expansion chamber (23) acting on the sliding block (28) by means of push rods (19) and being pushed forward by return springs (27), with a gas borehole (20) penetrating the wall of the barrel (1) and the plunger support (24), the gas-powered actuator (2) further comprising an outlet channel (22) formed by the protruding, foremost part of the annular piston (18) with the overflow limit (21) of the plunger support (24) and the region before it, said outlet channel (22) being fluidly separated from the expansion chamber (23) when the annular piston (18) is at rest and being fluidly connected with the expansion chamber (23) after a backward displacement of the annular piston (18).

A2. Rifle according to paragraph A1, characterized in that the disconnection is made by at least one overflow limit (21) on the plunger support (24).

A3. Rifle according to paragraph A1 or A2, characterized in that the annular piston (18) has several outlet channels (22) of different geometrical design, in particular different energy selector lengths (31*a, b, c, d*).

A4. Rifle according to paragraph A3, characterized in that an adapter (35) is axially provided between the annular piston (18) and the locking sleeve (3) whose forward front face extends in a corrugated manner with respect to a normal axis on the operating axis (37), and that a rear-facing surface (38) of the annular piston (18) is corrugated in a complimentary manner.

A5. Rifle according to one of the foregoing paragraphs characterized in that a labyrinth seal (26) is provided between the plunger support (24) and the annular piston 18.

A6. Rifle according to one of the foregoing paragraphs, characterized in that the plunger support (24) has an internal contour with recesses (40).

A7. Rifle according to paragraph A4, characterized in that a positional fixation (33) about the operating axis (37) is provided, which is configured by way of at least one gradation (38) to be complimentary in shape to the adapter (35).

A8. Rifle according to one of the foregoing paragraphs, characterized in that the locking sleeve (3) has lateral guide extensions (34).

A9 Rifle according to one of the foregoing paragraphs, characterized in that the push rods (19) are of a one-piece design.

A10. Rifle according to one of the foregoing paragraphs, characterized in that at the annular piston (18) has numerous blind holes in the circumferential direction The terms "front," "back," "above," "below" and so on in the common form and with reference to an item in its normal position of use are used in the description and the claims. This means that, in a firearm, the muzzle of the barrel is thus "in front," that the lock and/or slide is moved to the "rear" by expanding gases, that the magazine, if present, points "downward," that the outlet device lies "under" the barrel, and the projectile flies "forwards," etc.

It remains to be pointed out that specifications in the description and the claims such as the "lower part" of a pendant, a reactor, a filter, a building, or a device or, generally speaking, an object, signifies the lower half and in particular the lower quarter of the overall height, the "lowest part" signifies the lowest quarter and in particular an even smaller part, while "middle region" means the middle third of the overall height (width-length). All of these descriptions have their common meaning, applied to the intended position of the item in question.

The term "essentially" in the description and the claims signifies a deviation of up to 10% from the specified value, if it is physically possible both downward and upward, otherwise only in the practical direction; in the case of degree specifications (angles and temperatures), this means±10°.

All indications of quantity and fractional part specifications, in particular those used to delimit this invention, should be understood to have a tolerance of ±10% insofar as they do not concern concrete examples, and are to be understood to have a ±10% tolerance; for example, 11% thus means from 9.9% to 12.1%. In the case of designations such as "a solvent," the word "a" is not to be regarded as a number but rather as an indefinite article or as a pronoun, unless something else emerges from the context.

Unless stated otherwise, the term "combination" and/or "combinations" stands for all kinds of combinations based on two of the relevant components all the way to numerous or all such components; the term "containing" also stands for "consisting of."

The characteristics and alternatives indicated in the individual embodiments and examples can be freely combined with those of the other examples and embodiments and can in particular be used for characterizing the invention in the claims without necessarily tasking along the other details of the respective embodiment and/or the respective example.

Listing of Reference Numerals

| | |
|---|---|
| 1 | Barrel |
| 2 | Gas-powered actuator |
| 3 | Locking sleeve |
| 4 | Upper housing and/or Upper |
| 5 | Support module |
| 6 | Guide(s) |
| 7 | Lock |
| 8 | Tension slide |
| 9 | Front shaft |
| 10 | Lower housing and/or Lower |
| 11 | Magazine holding device |
| 12 | Pulling unit |
| 13 | Grip stock |
| 14 | Slide stop device |
| 15 | Central system lock |
| 16 | Magazine |
| 17 | Shaft |
| 18 | Gas piston, annular piston |
| 19 | Pressure rod, push rod |
| 20 | Gas borehole |
| 21 | Overflow limit |
| 22 | Outlet channel |
| 23 | Expansion chamber |
| 24 | Plunger support |
| 25 | Pin(s) |
| 26 | Labyrinth seal |
| 27 | Return spring(s) |
| 28 | Sliding block |
| 29 | Lock head unit |
| 30 | Spring unit |
| 31 | a, b, c, d . . . energy selector length |
| 32 | Recess |
| 33 | Positional fixation |
| 34 | Guide extension |
| 35 | Adapter |
| 36 | Weapon center plane |
| 37 | Operating axis |
| 38 | Gradation |
| 39 | Guiding piece |
| 40 | Recesses |

What is claimed is:

1. A firearm, comprising:

a framework;

a barrel that is firmly mounted within the framework, the barrel defining an operating axis;

a locking sleeve that is connected to the barrel, the locking sleeve including a lock, a sliding block, and a gas-powered actuator;

wherein the gas-powered actuator includes:

a plunger support having an annular piston that is located in a displaceable manner on the plunger support;

an annular expansion chamber in a region behind a front surface of the annular piston, the annular expansion chamber being defined by an axial section of the annular piston having a reduced internal radius in combination with the plunger support;

wherein the expansion chamber:

is fluidly connected with a gas borehole penetrating a wall of the barrel and the plunger support;

is urged in a forward direction by one or more reset springs; and is configured to act upon the sliding block by way of one or more push rods;

the gas-powered actuator further comprising an outlet channel defined by a foremost protruding portion of the annular piston in combination with an overflow limit of the plunger support and a region forward of the overflow limit; and wherein the outlet channel is fluidly separated from the expansion chamber when the annular piston is at rest, and is fluidly connected with the expansion chamber after a backward displacement of the annular piston.

2. The firearm according to claim 1, wherein when the annular piston is at rest the front surface of the annular piston contacts the overflow limit on the plunger support, thereby fluidly separating the outlet channel and the expansion chamber.

3. The firearm of claim 1, wherein the firearm is a rifle.

4. The firearm of claim 1, wherein the annular piston includes a plurality of outlet channels, each having a different geometrical design than the other outlet channels.

5. The firearm of claim 4, wherein each of the plurality of outlet channels corresponds to a distinct energy selector length.

6. The firearm of claim 4, further comprising an adapter that is axially disposed between the annular piston and the locking sleeve; wherein a forward front face of the adapter extends in a corrugated manner with respect to an axis normal to the operating axis; and a rear-facing surface of the annular piston is corrugated in a complementary manner to the forward front face of the adapter.

7. The firearm of claim 1, further comprising a labyrinth seal disposed between the plunger support and the annular piston.

8. The firearm of claim 1, wherein the plunger support defines an internal contour incorporating a plurality of recesses.

9. The firearm of claim 6, further comprising a positional fixation about the operating axis that is configurable by way of at least one gradation that is complementary in shape to the adapter.

10. The firearm of claim 1, wherein the locking sleeve includes a plurality of lateral guide extensions.

11. The firearm of claim 1, wherein each of the one or more push rods has a one-piece design.

12. The firearm of claim 1, wherein the annular piston includes a plurality of blind holes in the circumferential direction.

13. A rifle, comprising:

a framework;

a barrel that is firmly mounted within the framework, the barrel defining an operating axis;

a locking sleeve that is connected to the barrel, the locking sleeve including a lock, a sliding block, and a gas-powered actuator;

wherein the gas-powered actuator includes:

a plunger support having an annular piston that is located in a displaceable manner on the plunger support, the annular piston including a plurality of outlet channels, each outlet channel having a different geometrical design than the other outlet channels, and each outlet channel corresponding to a distinct energy selector length;

an annular expansion chamber in a region behind a front surface of the annular piston, the annular expansion chamber being defined by an axial section of the annular piston having a reduced internal radius in combination with the plunger support;

wherein the expansion chamber:

is fluidly connected with a gas borehole penetrating a wall of the barrel and the plunger support;

is urged in a forward direction by one or more reset springs; and is configured to act upon the sliding block by way of one or more unitary push rods;

the gas-powered actuator further comprising an outlet channel defined by a foremost protruding portion of the annular piston in combination with an overflow limit of the plunger support and a region forward of the overflow limit; and wherein the outlet channel is fluidly separated from the expansion chamber when the annular piston is at rest, and is fluidly connected with the expansion chamber after a backward displacement of the annular piston.

14. The rifle of claim 13, further comprising an adapter that is axially disposed between the annular piston and the locking sleeve; wherein a forward front face of the adapter extends in a corrugated manner with respect to an axis normal to the operating axis; and a rear-facing surface of the annular piston is corrugated in a complementary manner to the forward front face of the adapter.

15. The rifle of claim 13, further comprising a labyrinth seal disposed between the plunger support and the annular piston.

16. The rifle of claim 13, wherein the plunger support defines an internal contour incorporating a plurality of recesses.

17. The rifle of claim 14, further comprising a positional fixation about the operating axis that is configurable by way of at least one gradation that is complementary in shape to the adapter.

18. The rifle of claim 13, wherein the locking sleeve includes a plurality of lateral guide extensions.

19. The rifle of claim 13, wherein the annular piston includes a plurality of blind holes in a circumferential direction.

* * * * *